United States Patent [19]

Aurness et al.

[11] Patent Number: 4,944,422

[45] Date of Patent: Jul. 31, 1990

[54] EXPANDABLE HOME PACKAGE DELIVERY BOX

[76] Inventors: Harold O. Aurness, 5808 Knox Ave. No., Brooklyn Center, Minn. 55430; Thomas G. Mahler, 3841 Unity Ave. North, Robbinsdale, Minn. 55422

[21] Appl. No.: 442,851

[22] Filed: Nov. 29, 1989

[51] Int. Cl.[5] ..... B65D 25/00

[52] U.S. Cl. ..... 220/20; 220/23

[58] Field of Search ..... 220/20, 23, 23.2, 23.4, 220/23.6, 23.8, 23.83, 23.86, 1.5

[56] References Cited

U.S. PATENT DOCUMENTS

| | | | |
|---|---|---|---|
| 1,984,345 | 12/1934 | Kennedy | 220/20 X |
| 2,555,073 | 5/1951 | Zdankoski | 220/20 X |
| 2,630,476 | 3/1953 | Zelov | 220/20 X |
| 2,936,066 | 5/1960 | Meksula | 220/23 X |
| 4,128,170 | 12/1978 | Elliott | 220/20 X |
| 4,512,503 | 4/1985 | Gioso | 220/23 X |
| 4,717,020 | 1/1988 | Viira | 220/23 X |

*Primary Examiner*—Steven M. Pollard

[57] ABSTRACT

An expandable delivery box, according to the teachings of the present invention is shown as a free-standing metal box with a full top cover, a fully enclosed expandable front box member and two fully enclosed, extendable side members. Two unique locks which can only be opened by delivery persons using special keys are supplemented by other hand latches and holds accessible after opening the unit to extend the expansion members, if necessary. After a delivery has been made the unit can then only be opened by the receiver of the delivery using one of two combination locks on the main frame of the unit or an expansion member. When the unit is closed it cannot then be opened by the combination locks again until another delivery has been made. The unit also includes means for marking receipts proving delivery was made and received.

7 Claims, 3 Drawing Sheets

16
19
12
14
10
182
56
18
8
34
90
127
180
178
122
20
30
160
140
134
138
142
158
172
168
128
214
216
220
18
19
17
40
124
136
170
174
176

Fig 6
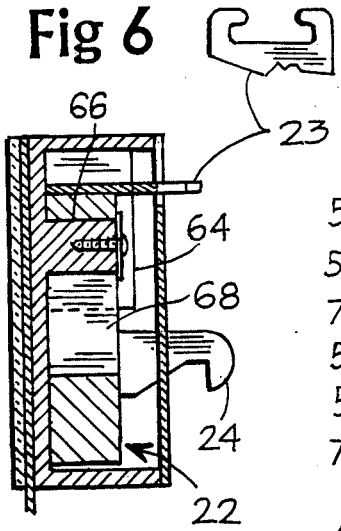
Fig 7
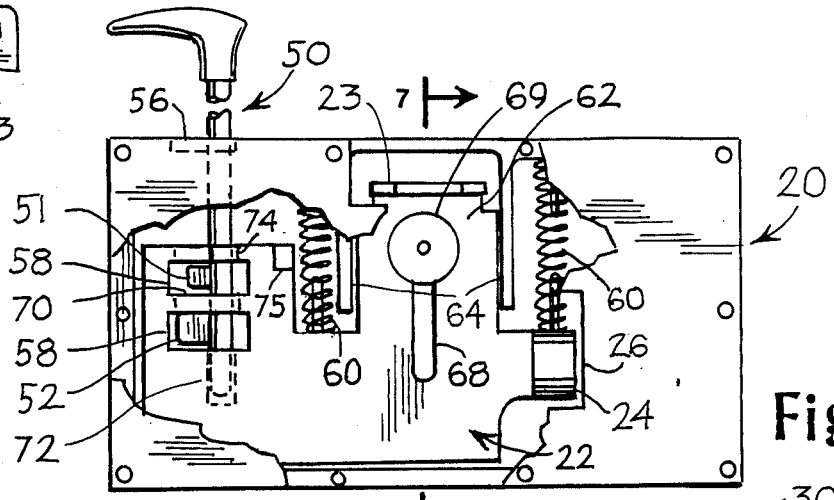
Fig 8
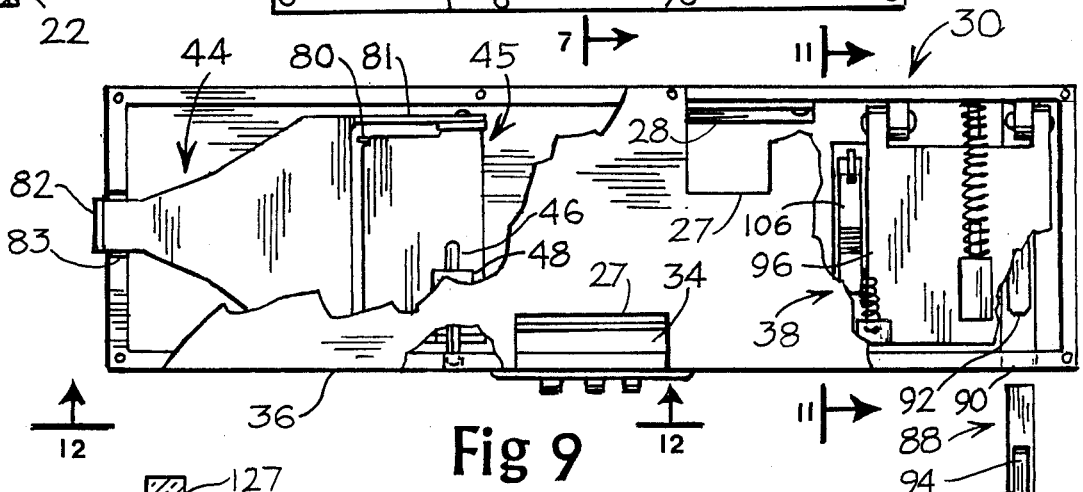
Fig 9
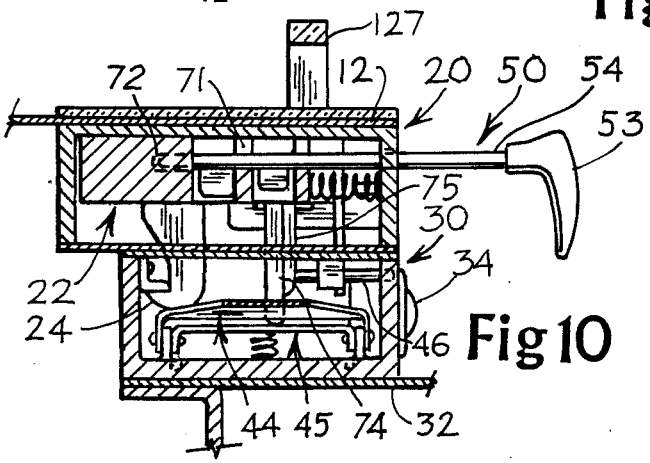
Fig 10
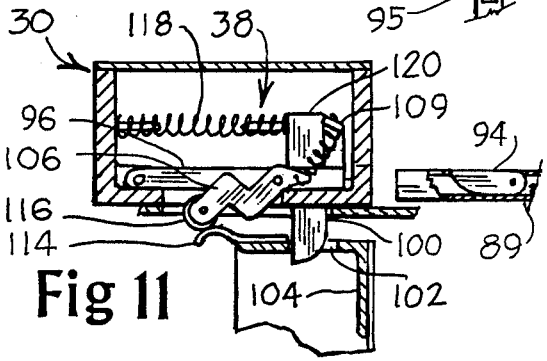
Fig 11
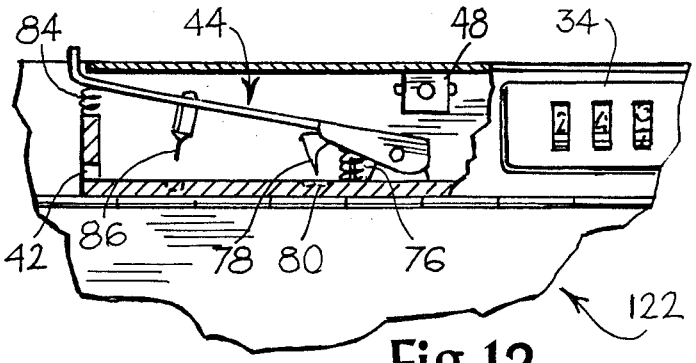
Fig 12
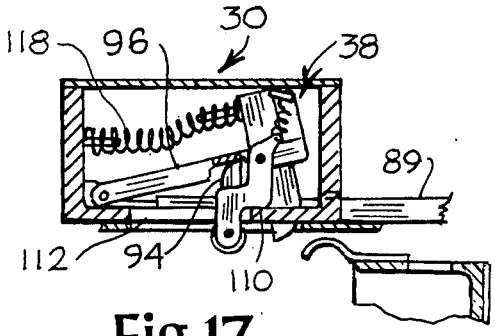
Fig 13

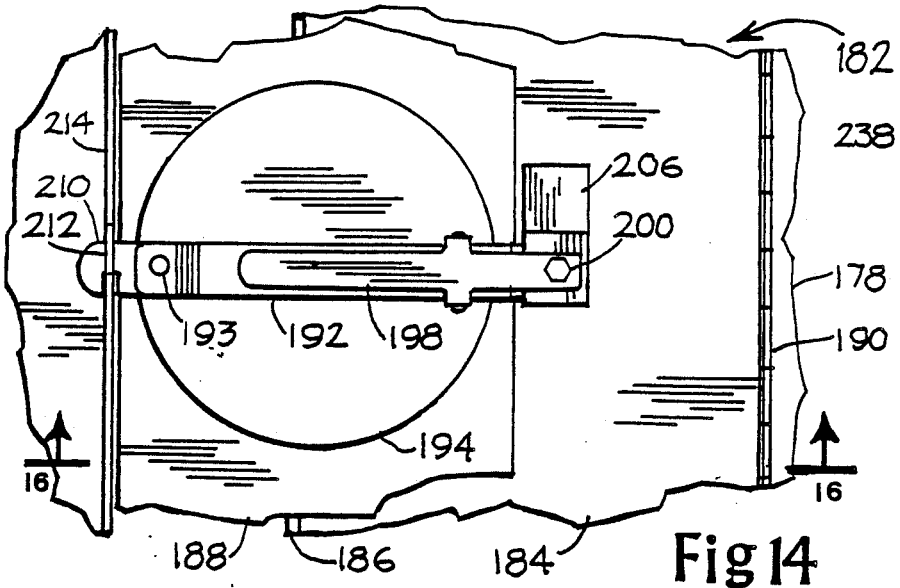
Fig 14
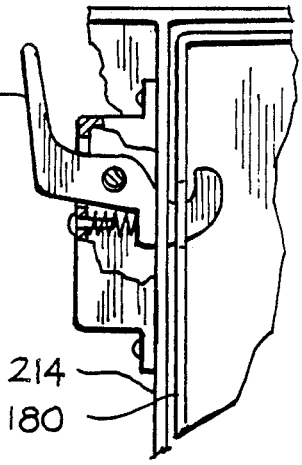
Fig 15
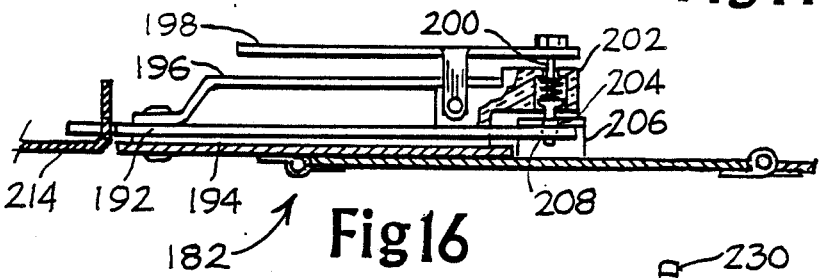
Fig 16
Fig 17
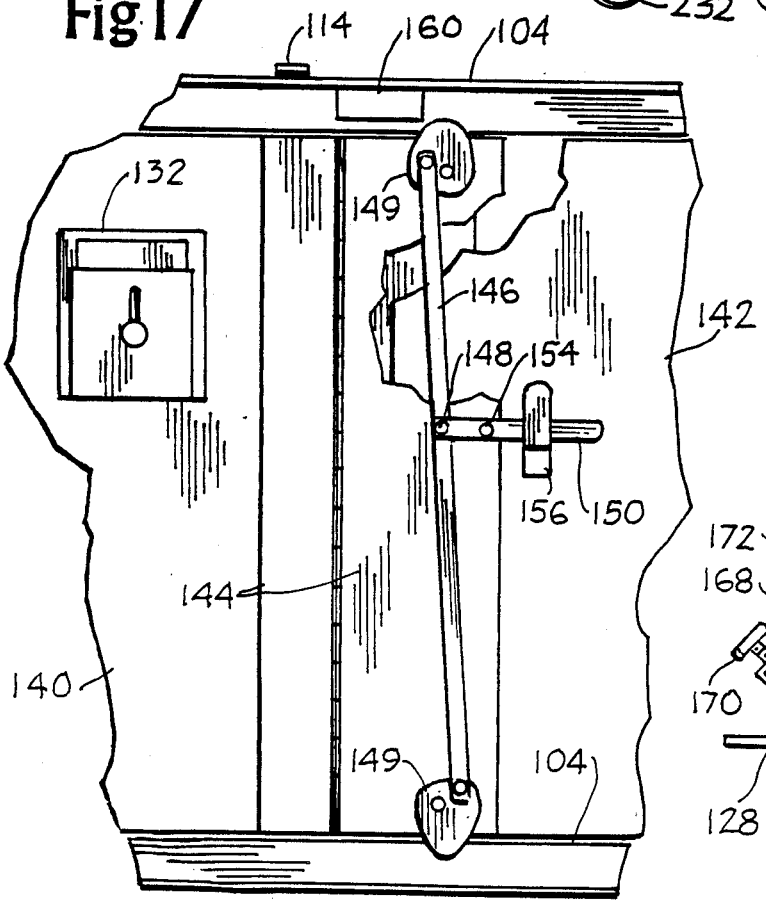
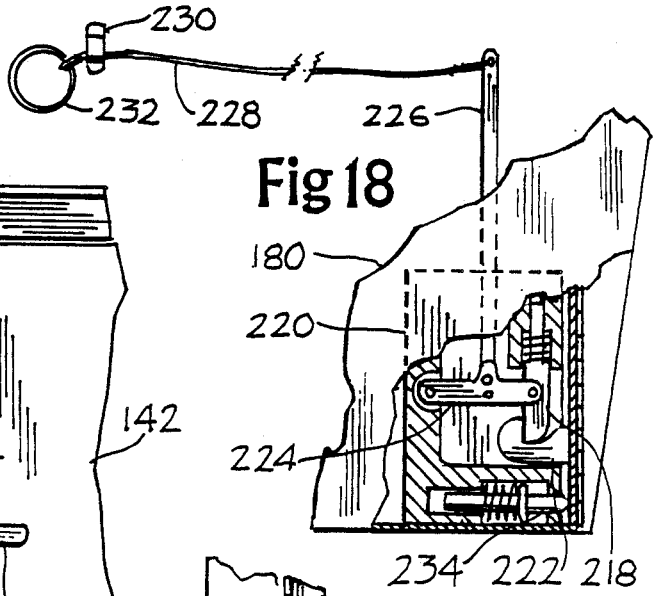
Fig 18
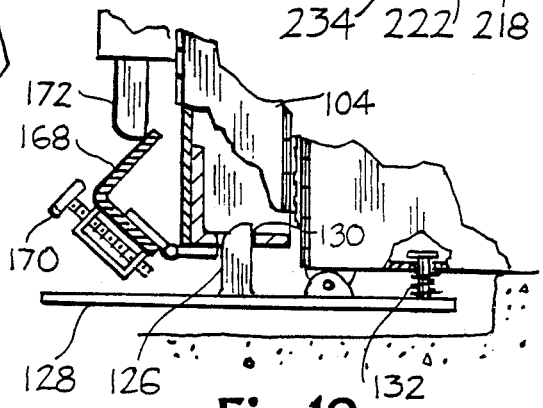
Fig 19

EXPANDABLE HOME PACKAGE DELIVERY BOX

SUMMARY:

The present invention relates generally to package delivery to homes or offices with absent tenants and the problem of securing the delivery against theft, and proving delivery was made and received.

The unit, of upright, rectangular shape, features a top cover, a front expansion box member for large packages and two side expansion arm members for holding average size packages and cooperate to accommodate long packages. The units also features two unique locks needing special keys, two combination locks and a number of latches, holds and receipt marking means.

The top cover has a spring-biased sliding base with a cover latch and a combination lock latch plus a kay receiving means for a pull-key which unlatches the cover for a delivery and then locks the combination lock after a delivery which results in the unit cover able to be opened only at the combinaiton lock by a receiver of the delivery. Opening the top cover also allows access by a delivery person to raise the side expansion members which are fully sheathed rectangular arms with end doors latched on the inside. The receiver of the delivery must gain access to the expansion arms through the top cover by dialing the combination lock. A folding bridge-plate assembly on the inside end of each expansion arm closes the gap left underneath by the extension, to secure against access to the latching means of the end doors by those not having the combination.

A step-lock in a housing on the front of the main frame of the unit unlocks the front expansion box which unfolds on hinges and has a floor, folding sides and front frame with doors, only opening from the inside when the top cover is unlatched by a combination lock on the front frame member. The step-lock features a latch on a hinged base plate, locking the front expansion box to the unit frame, with means in the form of a step-shaped bar to allow the step-lock to remain open while the expansion box is in use. The step-lock is opened by a release tool key which features a rotatable part which raises the step-lock base and latch when thrust into the lock onto a receiving member. The front expansion box can only be retracted when the receiver of the delivery dials the combination lock on the front frame member allowing the cover to be lifted and enabling the box to be retracted and automatically locked by the front expansion box latch when the step-bar is tripped in the step-lock.

Three receipt marking means are provided in the unit. Two are together in a main lock housing on the unit frame and provide receipts for the delivery person and receiver marked by tears in the receipt. One receipt marker is hand operated and the other marke automatically by closing the top cover. The other receipt marker is on the inside of the front expansion box and is hand operated.

LIST OF ILLUSTRATIONS

FIG. 6 is a frontal view of part of the combination lock latch of FIG. 7.

FIG. 7 is a cross-sectional view of the cover lock housing according to section line 7—7 of FIG. 8.

FIG. 8 is a cutaway view of the bottom of the cover lock housing.

FIG. 9 is a cutaway view of the top of the main lock housing.

FIG. 10 is a cross-sectional view of the cover lock housing and main lock housing in normal position according to section line 10—10 of FIG. 1.

FIG. 11 is a cross-sectional view of the step lock assembly in closed position according to section line 11—11 of FIG. 9.

FIG. 12 is a partial cutaway and cross-sectional view of the receipt marker assembly according to section line 12—12 of FIG. 9.

FIG. 13 is a cross-sectional view of the step lock assembly in unlocked position extrapolated from FIG. 11.

FIG. 14 is a partial top view of the bridge plate assembly in locked position according to section line 14—14 FIG. 3.

FIG. 15 is a partial cutaway view of the spring lock lever which holds the extension arms.

FIG. 16 is a cross-sectional and cutaway view of the bridge plate assembly according to section line 16—16 of FIG. 14.

FIG. 17 is an inside partial view of the expansion box doors with the locking bar and handle according to section line 17—17 of FIG. 4.

FIG. 18 is a partial cutaway view of the extension arm door lock according to section line 18—18 of FIG. 3.

Figures 1, 2, 3, 4, 5:
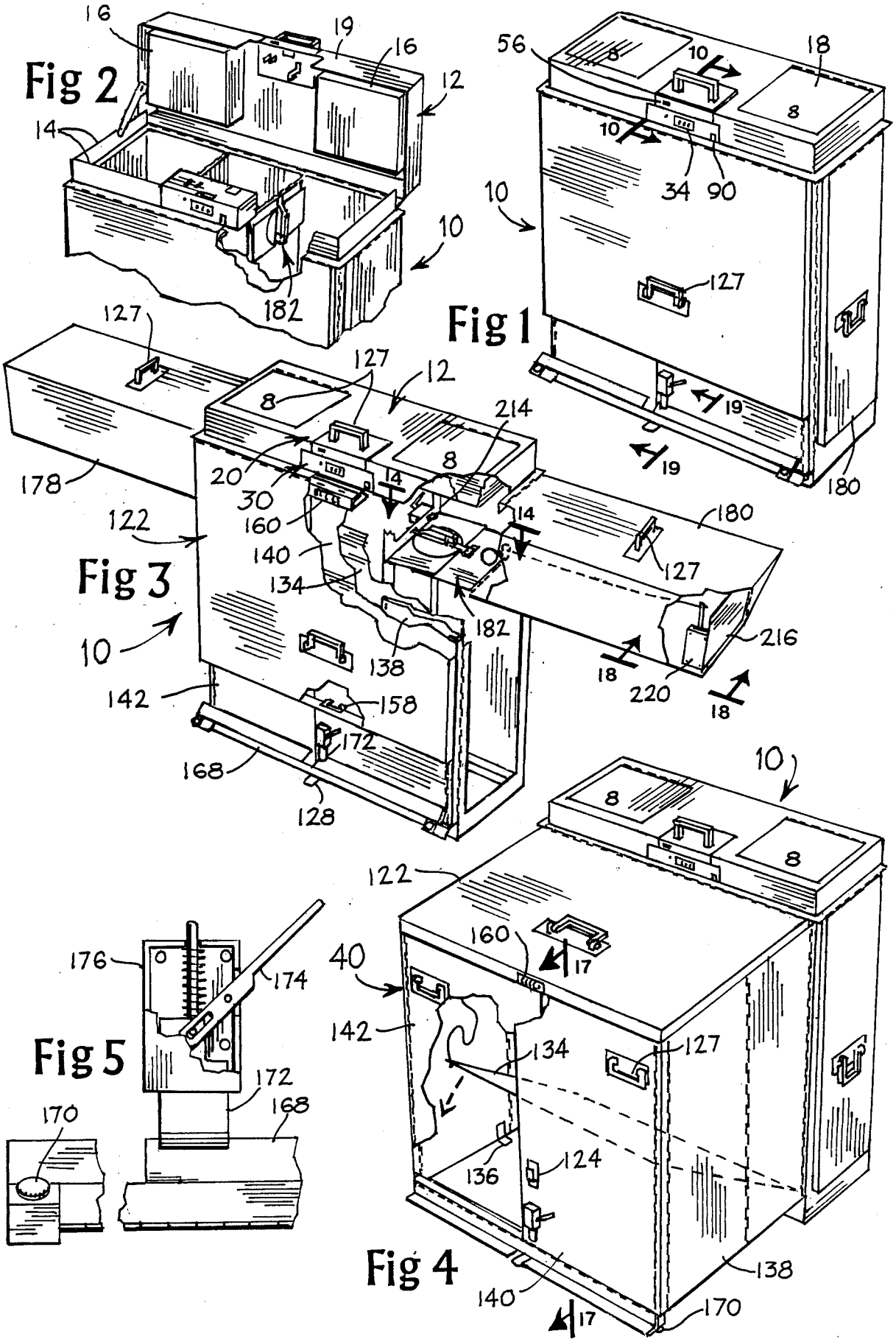
FIG. 1 is a perspective view of the whole unit in the closed and locked position.
FIG. 2 is a perspective partical view of the unit showing the top cover open.
FIG. 3 is a perspective view of the whole unit with the side extension arms raised.
FIG. 4 is a persepective view of the whole unit with the front expansion box extended with a cutaway view of the inside.
FIG. 5 is a partial cutaway frontal view of the spring latch and angle iron bar with adjustable legs which holds up the extended expansion box.

FI. 19 is a partial cutaway view of the bottom latch according to section line 19—19 of FIG. 1.

DESCRIPTION

An expandable package delivery box according to the teachings of the present invention is wholly shown in the drawings and generally designated 10. Unit 10, in its closed upright position, is of rectangular shape, wider in one horizontal dimension than the other, and a little higher than its width. It is secured against theft by a variety of four main locks and ten supplemental locks and/or holds which combine to secure three expansion members and a hinged top.

The top cover 12, an inverted box shaped which overlaps flanges 14 on the main frame of unit 10 when closed, also contain two integrated, shallow boxes 16 with hinged covers 18 without locks opening from the top at each end to receive small flat packages. Centrally located on the underside of the top cover 12 at its front side 19 and between the two boxes 16 is a cover lock housing 20 containing the sliding lock base 22, which includes a combination lock latch 23 on the front side 19 and cover latch hook 24 on the right side. Latch hook 24 extends down through an opening 26 in the cover lock housing 20 and through an opening 27 in the main lock housing 30 to engage a catch bar 28 on said housing back wall. The main lock housing 30 sits on a top front frame member 32 of unit 10.

Contained within the main lock housing 30 is the top cover combination lock 34 centrally located on the front wall 36 of the main lock housing and used for opening the top cover 12 after a delivery; the step-lock unit 38 at one end of the main lock housing locking the front expansion box 40 in folded position; a receipt slot 42 and receipt markers 44 and 45 assembled at the opposite end of the housing. Near the receipt marker 45 is a spring biased delivery indicator pin 46 held within a rectangular housing 48 on the ceiling of the main lock housing which signals a package has been delivered when the top cover 12 has been closed.

To open the top cover 12, a hefty pull key 50 with an immovable handle 53 at one end and two large rectangular teeth 51 and 52 spaced apart on the same plane on the key shaft 54 on an opposite end, is inserted into a key hole 56 near one end of the outside wall of the cover lock housing 20 and into a divided space 58 in the sliding lock base 22. The sliding lock base 22, of irregular shape, is constrained by spiral springs 60 on either side of the combination lock latch extension 62 of the base which is held between two guide walls 64 and by a guide bar 66 from the housing riding in a guideslot 68 centrally located in the latch lock extension 62. A washer 69 on the bottom of the guide bar holds the sliding lock base 22 vertically in place. The divided space 58 has a divider 70 over which the special key 50 slides in a divider slot 71 and into a hole 72 in the sliding base 22 beyond. When the pull key 50 is turned 90° the key tooth 51 and 52 engages the divider 70 thus allowing the sliding lock base 22 to be pulled forward releasing the cover lock latch 24 from the catch bar 28 in the main lock housing 30. The function of key tooth 51 is to help guide the pull key through space 58. In closing the top cover 12, the special key 50, still in the lock from opening, is pulled forward again as the two housings, 20 and 30, meet thus engaging the combination lock latch 23 with the combination lock 34 through opening 27 in the main lock housing 30. This means the delivery person cannot reopen this part of unit 10 with key 50 until the package has been removed by a person who knows the combination to the top cover combination lock 34.

The sliding lock base 22 also features two stationary levers 74 and 75 which protrude down into the main lock housing 30. The receipt marker lever 74 presses against the top of the receiver's receipt marker 45 which is a light gauge plate rotatably mounted at one end by means at each side to the housing floor and angled upward at about 10° toward the left side of the main lock housing 30 held there by a spiral spring 76 underneath. The upper end of the receipt marker 45 features small vertical pointed cutters 78 at each side which press into a receipt when the top cover 12 is closed and into shallow cutter grooves 80 in the bottom of the main lock housing 30. They are held in the grooves until the receipt is removed through the horizontal receipt slot 42 at the left end of the housing. The receipt cutters 78 tear short slits in the receipt as it is being drawn out until the pressure lifts the cutters out of the slits and grooves 80. These marks on the removed receipt prove the package has been received by the owner of unit 10.

The other aforementioned stationary lever 75 engages the delivery signal pin 46 held in the signal housing 48 forcing it forward into view to indicate a delivery has been made when the sliding lock base 22 is pulled forward. It returns to a hidden position, when released, by spring action within the signal housing 48.

Another member of the receipt marker assembly, receipt marker 44, is similar to the previously described receipt marker 45 but larger and longer with leg extensions 81 extending down on either side of receipt marker 45 and rotatably fastened by means to the main lock housing floor. The upper part of the receipt marker 44 extends upward beyond receipt marker 45 at a 10° angle narrowing to a square point 82 at an opening 83 at the top left edge of the main lock housing 30 where it is held by a vertical spiral spring 84 underneath. The delivery person may press marker 44 by hand to mark his receipt before closing the cover. A pointed spike 86 in the middle underside of the delivery receipt marker plate 44 is forced down into the receipt leaving a small puncture which proves a delivery was made and at what day and time.

To expand unit 10 to receive large packages, a special key, or release tool 88, with a square, hollow shaft 89 and an immoveable handle member at one end, is thrust into an opening 90 on the right side of the main lock housing 30 and onto a plug 92 protruding horizontally from the back wall of the housing. The plug 92 forces a wedge-shaped member 94 hinged within the release tool 88, upward through an opening 95 in the top of the tool which raises a steplock base 96 of the steplock unit 38 which is hinged to the back wall of the main lock housing 30. The steplock base 96, in turn, raises the steplock latch 100 extending down from it out of an opening 102 in the top of the expansion box frame 104.

To keep the steplock latch 100 raised after removing the release tool 88, a small step-shaped flat bar member 106, vertically attached rotatably at its top end to the left side of the steplock base 96 with a spiral spring 108 connecting an extended top part of the step bar 106 to a raised part 109 on top of the steplock base 96, is pulled up by the action of the release tool 88 and the spiral spring 108 to sit on a shelf 110, or ledge, formed by an opening 112 in the bottom of the main lock housing 30. This allows the expansion box 30 to be unfolded. The steplock latch 100 automatically drops back into the opening 112 in the top of the expansion box frame 104 when the expansion box 30 is closed and a stationary, arched lever 114 on the top of the expansion box frame 104, trips the bottom of the step bar 106 forward off the shelf 110 aided by a wheel 116 on the bottom of the step bar. A spiral spring 118 expanded between the back wall of the main lock housing 30 above the steplock base 96 and an extension 120 of the step-lock latch 100 also helps to keep the latch in closed position.

The expansion box 40 can be pulled forward for use after the expansion top 122 has been lifted out of the way from a spring bar hold 124 on the front of the expansion box 30 and a bottom latch 126, holding the bottom of the expansion box 30 in folded position, is released by stepping on the bottom latch lever 128 rotatably attached and extending from the bottom of unit 10. The bottom latch lever 128 holds the bottom latch 126 extending vertically into an opening 130 in the bottom of the expansion box frame 104 and held by a spiral spring 132 at the end of the latch lever 128. Handles 127 are are provided on the unit for pulling the expansion member and covers.

After full extension of the expansion box 40, a floor member 134 folded upwards inside in the closed position from a hinged bottom edge, is pulled down to rest on the expansion box frame 104 and on L-shaped holders 136 attached to the inside bottom edges of the hinged side walls 138 of expansion box 40. At this point the delivered package can be put into the expansion box from the top or through double doors at the front.

Double overlapping doors 140 and 142 hinged vertically to either side of the expansion box frame 104 are reinforced by an overlapping flap plate 144 vertically hinged to near the edge of the outside door 140 and overlapping the inside door 142. A vertical bar 146 on this flap plate 144 extends to two symetrically identical oval-shaped flats 149 rotatably mounted off-center on the doors near the top and bottom edges. When activated by a handle 150 mounted rotatably at the center point 148 of the vertical bar 146 and horizontally at a point 154 to the flap plate 144 near the edge, it closes the flats 149 simultaneously over the top and bottom edges of the expansion box frame 104 thus locking the double doors. The handle 150 then slides into a holding bar 156 in the opposite door 142. These double doors are used mainly for packages too heavy or bulky to be let in or removed from the top.

To complete the process of expanding the front expansion box 40 for use, the expansion box top 122, in an upright position to allow the expansion box 40 to unfold, is lowered by handle 127 over the expanded box with a latch 158 in the frame of the top engaging and locking into the expansion box combination lock 160 on the expansion box frame 104 affter a package has been put into the box. The combination lock now allows the top or front to be opened. Means to hold the expansion box frame 104 up off the ground or platform is provided by an angle iron bar 168 hinged lengthwise to the bottom of the expansion box frame 104 with vertically adjustable legs 170 at either end. The angle iron bar 168 is held up when not in use by a spring activated latch 172 with a latch release lever 174 in a latch housing 176 located near the bottom edge of door 140. A receipt box 132 on the inside of door 140 provides a service similar to that provided by the previously described receipt arrangement in the main lock housing 30.

Forming the right and left sides of unit 10 are symetrically identical rectangular extension arms 178 and 180 designated to accommodate long packages. They are hinged at the top to swing up to a horizontal position to be used singly or together. Each expansion arm is held in horizontal, or receiving position, by a bridge plate assembly 182 consisting of double horizontal rectangular plates with a bottom plate 184 hinged at one edge 186 along its full width to the center of the top plate 188 for support and the same plate 184 hinged to the lower inside edge 190 of the expansion arm 178 or 180. A swivel latch 192 with a large bottom disk plate support member 194 swivels on the top rectangular plate 188 from a swivel point 193 near the inside edge of the top plate 188. A disk handle 196 centered on the disk plate 194 running from the swivel center point 193 has a horizontal lever 198 moveably attached above it which activates a spring loaded locking pin 200 in a pin housing 202 extension of the handle 196 beyond the edge of the top plate 188. The locking pin 200 drops into a hole 204 in a raised lock bar 206 on the bottom plate 184 and into a hole 208 in the swivel latch 192 extending beyond the disk plate 194 under the raised lock bar 206. At the other, or inside end, of the swivel latch 192 is a hook 210 extending horizontally beyond the edge of the disk plate 194 to engage and lock into a slot 212 in the unit frame support cross member 214. When the expansion arms are in a lowered position the bridge plate assemblies 182 hang folded inside the expansion arms. Handles 215 are provided on each extension arm for pulling the extension arms to a horizontal position.

A vertically hinged access door 216 on the outside ends of each expansion arm is kept locked by a vertical spring activated sliding latch 218 in a latch housing 220 on the inside wall of the expansion arm which engages a hook bar 222 extending horizontally from the inside of the expansion arm access door 216. A short horizontal bar 224 rotatably connected to inside the latch housing 220 at one end and the sliding latch 218 at the other end lifts the latch for opening the access door 216 when a long lever part 226 of the bar extending upward from the center of the bar 224 is pulled sideways by a pull cord 228 attached to the top of the lever 226. The pull cord 228 extends horizontally along the inside of the expansion arm to a holding clip 230 at the other end where a pull ring 232 is attached to the cord. In the lower part of the latch housing 220 is a spring powered pusher button 234 to push the access door 216 ajar when the pull cord 228 is pulled releasing the sliding latch 218. Access to the pull ring 232 is made by dialing combination lock 34 to open unit cover 12. At that point the expansion arm can be lowered after removing the package.

The expansion arms 178 and 180 are kept in closed, or lowered, position by spring lock layers levers 238 mounted on inside frame members 214 of unit 10 which automatically lock into openings in the underside of the expansion arms. The lock levers are released by hand to raise the expansion arms.

We claim:

1. An expandable delivery box of an upright, rectangular shape comprising a box-shaped hinged cover at the top with two integrated shallow boxes with lock-free lids with handles for casual deliveries; which top cover is kept locked, before a delivery, by a latch hook member of a spring-biased sliding latch base within a cover lock housing on the underside of the top cover, which latch hook extends down to a catch bar in a main lock housing on the unit frame; a pull-key, carried only by a delivery person, inserted into a keyhole of the main lock housing and onto a section of the sliding latch base designed to accommodate the key teeth when turned, allows a pulling action to unlock the top cover housing from the main lock housing; said main lock housing also comprising a first combination lock accessible from outside the unit, a first automatic receipt marking means activated by closing the top cover, which action automatically locks the top cover at the combination lock; a second receipt marking means handpressed by the delivery person; a spring-biased delivery signal automatically activated by closing the top cover only after a delivery; locking means for a front expansion box member of the unit comprising a step-lock base plate with a latch to hold the expansion member closed, means to automatically hold the locking means open while the expansion member is in use and automatically release when closed, a key receiving member plus a separate key, or release tool, carried only by a delivery person, to unlock the step-lock; a said front expansion box comprising hinged, folded sides with bottom placed tabs to hold a hinged, folding bottom member, a hinged, folding cover with a handle and a combination lock latch on its front side, a vertical front door assembly, with handles, on a frame hinged to the folding sides, which frame is secured in folded position at the bottom by a spring-biased lever on the main frame of the unit, with the doors of the front door assembly overlapping with an overlapping flap plate on the back of one of the doors featuring a locking means not accessible from the front but only when the expansion box cover is up, locking the doors at the top and bottom frame members, a second combination lock on the face of the top expansion frame member to receive the combination latch from the cover; a hinged support means to hold the front of the expansion box off the ground and kept in a retracted position by a spring-biased latch; a third receipt marking means on the inside of one of the front doors and further comprising, in the main part of the unit, covered hinged extension arms folded into each narrow side of the unit for accommodating long packages when extended horizontally and secured in closed position automatically by locking means inside the unit which can be unlatched by a delivery person when the top cover is open, comprising hinged, handless doors on each outer end with automatic locking means unlatchable only from the inside, including means for automatically pushing the doors ajar from the inside, a hinged bridge-plate assembly on each inside end of the arms for bridging the gap left underneath when the arms are extended; wherein after a delivery has been made to the unit, the delivery person cannot reopen the unit with the pull-key or release tool until it has been opened by the receiver using the combination lock and, conversely, the unit cannot be reopened by the receiver using the combination lock until another delivery has been made by a delivery person.

2. The delivery box of claim 1 wherein the means to unlock the top cover of the unit by a delivery person, and, subsequently by the receiver of the delivery, comprises, in combination, a separate pull-key, used by the delivery person, comprising a key shaft, a key handle at one end, two key teeth spaced apart parallel to the shaft near the other end; a cover lock housing, on the unit, attached to the ceiling of the top cover, containing a spring-biased horizontal sliding latch base plate of irregular shape, a combination latch on a front extension end of the sliding base extending down to, but not into, a combination lock on a front side of a main lock housing on the unit frame; a latch hook on a side end of the sliding latch base extending down into the said main lock housing to a catch bar; with a section of the sliding latch base plate, at another side end, featuring two equal rectangular wells spaced apart in parallel relation with a shallow channel between them on the divider with the shallow channel also repeated on an opposite edge of the first well near, in line, and level with a keyhole on the front face of the cover lock housing; wherein when the pull key is thrust by a delivery person into the keyhole of the top cover housing with the key teeth horizontal, it passes through the shallow channel to the first well and to the second well through the divider channel to a hole in the back wall of the second well into which the end of the pully-key enters, wherein when the key is turned 90° downward the key teeth engage the sides of the wells enabling the delivery person to pull the sliding latch base forward which disengages the latch hook from the catch bar in the main lock housing enabling the top cover to be swung up; and when the cover is to be closed after the delivery, the key is pulled forward again as the cover closes thus engaging the combination latch with the combination lock which enables the top cover to be opened only by the receiver using the combination lock, but when reclosed, cannot then be reopened by the receiver until another delivery has been made, repeating the cycle.

3. The delivery box of claim 1 wherein the means to unlock the front expansion box for a delivery and keep it unlatched comprises a step-lock unit comprising a base plate hinged to the back inside wall of the main lock housing spring aided to rest horizontally on the floor of the housing, a latch extending down from the base plate through openings in the main lock housing and the top frame member of the front expansion box to lock the expansion box, a step-bar having a step-like shape attached rotatably to a side of the base plate extending a lower leg down through an opening provided for it in the floor of the housing to an arched trip-bar member of the expansion box and with a spiral spring extending from a short angled extension of the top of the step-bar to a raised part of the top of the base plate, which spiral spring assists the step-bar to its function of holding up the base plate and latch while the front expansion box is extended, a plug bar member of the step-lock unit, having a square cross-section extending horizontally from the back inside wall of the housing in spaced relation below the base plate, a release tool, or key, independent of the unit, with a rotatable member on its shaft and a handle; wherein when the release tool is thrust into a keyhole in the housing and onto the bar plug the rotatable member of the release tool is forced upward by the bar plug which raises the front of the base plate withdrawing the latch from the expansion box top frame member allowing it to be expanded and, concurrently, pulls up the step-bar to sit on the edge of the opening provided for it, to hold the base plate and latch up until dropped and locked automatically when the expansion box is closed, tripping the step-bar off the edge of the opening, aided by a wheel on the end of the step-bar.

4. The release tool of claim 1 comprising a length of shaft having a square, hollow cross-section open at one end, a fixed handle at the other end, and a short, wedge-shaped bar with a rectangular cross-section rotatably fastened within the shaft close to the open end with an opening directly above the wedge-shaped bar; wherein when the release tool, or key, is thrust onto the bar plug in the main lock housing of the unit, the bar plug enters the open end of the shaft forcing the wedge-shaped bar up through the shaft opening, which, in turn, forces up the base plate of the step-lock unit and, when retracted, the wedge-shaped bar is forced back into the shaft at the keyhole in the main lock housing.

5. The expandable delivery box in claim 1 wherein the unit features three expansion members plus a unit cover, with two uniques locks needing special keys, and two combination locks, for securing all the members in expanded or unexpanded positions; with the top cover secured before a delivery by a sliding lock needling a pull-key used by a delivery person to open it and by a combination lock on the unit frame to open it by the receiver of the package after delivery; with a front expansion box on the unit, opened by a delivery person using a release tool, or key, in a step-lock in a housing on the unit frame, which expansion box comprises a cover and floor hinged to the unit frame, foldable sides hinged to the unit frame and to the front frame member of the expansion box which features two front doors unlatchable only from the inside and a combination lock at the top latched to the cover member which allows entry only by a receiver of the delivery through the cover; with two, sheathed expansion arm members, opposite each other in the unit sides, hinged to the top of the unit frame and used for long or extra-long packages with foldable, lockable means underneath to bridge the gap made by the extension, and which extension arms are unlocked for a delivery by opening the top unit cover with the pull-key to allow access to a spring lock lever holding each arm to the unit frame, or entry by the receiver of the delivery by dialing the combination lock to open the unit cover enabling pull rings to be reached on the inside to unlatch the end doors of the expansion arms, and which entry also allows the expansion arms to be retracted for the next delivery; wherein it can be shown that the unit is in a constantly locked mode using alternate locking means to keep the unit secure and relatively tamper-proof.

6. The expandable delivery box of claim 1 wherein two receipt marking means comprises, in combination: a stationary lever extending down from the sliding latch plate in the cover lock housing to a first receipt marker in the main lock housing comprising a light gauge rectangular plate with small cutters at each short end which press into floor slots in the housing when activated, which reciept marker is hinged to the housing floor and spring biased to a slightly upward angle; a second spring biased receipt marker, tandem to the first receipt marker, hinged to the housing floor and made of light-gauge plate tapering to a blunt, narrow end extending out the end of the housing through a slot at the top; a slot opening at the bottom of the same end to place and retract the receipt; wherein the receipt is marked by hand by the delivery person pressing the end of the second receipt marker, who then removes a top copy and returns the other copy to the receipt area before closing the top cover which marks that copy with the cutters of the first receipt marker when the top is closed and the lever from the sliding latch base presses the top of the marker down to automatically mark the receipt, wherein both receipts are marked proving delivery was made and received.

7. The delivery box claim 1 wherein the means to securely close the gap in the unit created by extending either side expansion arm features a bridge plate assembly comprising a rectangular bottom plate and a rectangular top plate of equal dimensions, with the bottom plate overlapping and hinged fully across the center of the top plate lengthwise and hinged also on the other side to the top inside edge of the expansion arm; a swivel latch bar welded across the diameter of a disc plate support and rotatably fastened though both parts near the circumference of the disc plate to the top rectangular plate near the non-overlapping edge and extending beyond the top plate to hook into an inside frame member of the unit, with the swivel latch also extending its other end under a raised lock bar on the bottom plate beyond the overlap to be secured by a spring biased vertical, retractable lock pin in a housing fixed near to and partially spaced above the end of the swivel latch and lock bar with the lock pin extending through holes in the lock bar and swivel latch; a handle, fixed at one end of the swivel point, extending up and back to attach to the pin housing; a lever in level, spaced relation above the handle, attached rotatably on either side to the pin housing and to the pin which raises the pin to allow the swivel latch to rotate for latching or unlatching; wherein the bridge plate assembly may hang idly inside the side expansion arm until needed when it is hand activated to cover the gap made underneath, by latching to the unit frame, with the elements of the assembly cooperating to create a strong bridge to frustrate any attempt of theft.

* * * * *